US006820907B1

(12) United States Patent
Haynes

(10) Patent No.: US 6,820,907 B1
(45) **Date of Patent: *Nov. 23, 2004**

(54) MULTI-UNIT CONCRETE BLOCK TONGS

(76) Inventor: Scott D. Haynes, 7801 Amber Hill Rd., Lincoln, NE (US) 68516

( * ) Notice: Subject to any disclaimer, the term of this patent is extended or adjusted under 35 U.S.C. 154(b) by 160 days.

This patent is subject to a terminal disclaimer.

(21) Appl. No.: 10/211,844

(22) Filed: Aug. 2, 2002

Related U.S. Application Data

(63) Continuation-in-part of application No. 09/951,258, filed on Sep. 12, 2001, now Pat. No. 6,550,833.

(51) Int. Cl.[7] ..... B66C 1/44

(52) U.S. Cl. ..... 294/63.1; 294/104; 52/125.2; 414/626

(58) Field of Search ..... 294/62, 63.1, 104, 294/110.1; 52/125.2, 749.13; 414/621, 623, 626

(56) References Cited

U.S. PATENT DOCUMENTS

| | | | | | |
|---|---|---|---|---|---|
| 1,192,504 | A | * | 7/1916 | Crum | 294/63.1 |
| 2,370,528 | A | * | 2/1945 | Fontaine | 294/63.1 |
| 2,782,067 | A | * | 2/1957 | La Bonte et al. | 294/104 |
| 2,866,660 | A | * | 12/1958 | McGuire et al. | 294/63.1 |
| 2,924,484 | A | * | 2/1960 | Tolsma | 294/104 |
| 3,037,806 | A | * | 6/1962 | Anderson | 294/110.1 |
| 3,207,548 | A | * | 9/1965 | Franziskus et al. | 294/104 |
| 3,614,151 | A | * | 10/1971 | Shadle | 294/104 |
| 4,320,985 | A | * | 3/1982 | Kleinemas | 52/749.13 |
| 4,545,609 | A | * | 10/1985 | Pasquazzi et al. | 294/104 |
| 5,820,180 | A | * | 10/1998 | Haupt | 294/104 |
| 6,370,837 | B1 | * | 4/2002 | McMahon et al. | 52/749.14 |

FOREIGN PATENT DOCUMENTS

| | | | | |
|---|---|---|---|---|
| GB | 2252071 | * | 7/1992 | |
| JP | 406080372 | * | 3/1994 | 294/110.1 |

* cited by examiner

*Primary Examiner*—Paul Chin
(74) *Attorney, Agent, or Firm*—Thomte, Mazour & Niebergall; Dennis L. Thomte

(57) ABSTRACT

A concrete block tong assembly which is designed to lift and transport a plurality of concrete blocks. The assembly is provided with three top support members pivotally connected at one end thereof to one end of three bottom support members. A lifting apparatus is operatively connected to the top three support members whereupon upward movement of the top three support members by the lifting mechanism will cause the top support members to pivot with respect to the bottom support members. A front plate is secured to one end of each of the top support members for movement therewith and a back plate is longitudinally adjustably secured to each of the bottom support members adjacent the other end thereof. A solenoid operated locking bolt is selectively movably mounted within each of the top support members and has an actuator rod which is movable between extended and retracted positions. When the solenoids are activated, the locking bolts are retracted to their unlocked positions so that when the lifting device raises the assembly, the top support members pivot with respect to the bottom support members to urge the front plates and back plates of the assembly into frictional engagement with the ends of the concrete blocks. A manual override is provided for manually moving the locking bolts into their unlocked positions.

1 Claim, 6 Drawing Sheets

MULTI-UNIT CONCRETE BLOCK TONGS

CROSS-REFERENCE TO RELATED APPLICATION

This is a continuation-in-part application of Petitioner's earlier application Ser. No. 09/951,258 filed Sep. 12, 2001, now U.S. Pat. No. 6,550,833 entitled "MULTI-UNIT CONCRETE BLOCK TONGS".

BACKGROUND OF THE INVENTION

1. Field of the Invention

This invention relates to block tongs and more particularly to a multi-unit block tong assembly which may be used to lift and transport large building blocks such as those used in retaining walls, steps, etc.

2. Description of the Related Art

Brick tongs have been used for many years to enable a workman to carry a plurality of bricks from a source of supply to a work site. The conventional brick tongs comprise plates or hooks disposed at ends of a pair of pivoting arms designed so that when the tongs are lifted, the plates or hooks are moved into engagement with the ends of the outermost bricks so that the bricks are firmly grasped to enable the bricks to be lifted and carried. During the past several years, large concrete blocks have been fabricated for use in retaining walls, steps, etc. The blocks are quite large and heavy and are difficult for a workman to move from a pallet or the like to the job site.

In the past, applicant devised a multi-unit concrete block tong assembly wherein the block tongs could lift and carry a plurality of concrete blocks from a pallet to the job site with the block tongs being supported from the end of a boom mounted on a skid-steer loader or the like. Although the block tongs of applicant's previous device did perform satisfactorily, the previous device required the presence of a worker to permit the block tongs to be selectively locked into the open position so that the tongs could be mounted on the concrete blocks and so that the block tongs could be removed from the concrete blocks once the blocks were properly positioned adjacent the job site. In the device described in applicant's co-pending application, applicant provided a means whereby the block tongs could be remotely selectively locked into the open position. Although the device of the co-pending application works extremely well, the device thereof did not have any means for manually overriding the electric solenoids thereof. The manual override feature has been found to be important in those situations wherein the supporting vehicle did not have the capability of electrically operating the electric solenoids or in those situations wherein the electric wires supplying power to the solenoids were inadvertently severed or damaged.

SUMMARY OF THE INVENTION

A multi-unit concrete block tong assembly is provided which includes three top support members pivotally operatively connected at one end thereof to one end of three bottom support members. A front plate is secured to one end of each of the top support members for movement therewith. A back plate is longitudinally adjustably secured to each of the bottom support members adjacent the other end thereof. A lifting apparatus is operatively connected to the three top support members whereupon upward movement of the three top support members by the lifting device will cause the top support members to pivot with respect to the bottom support members. A solenoid operated locking bolt is selectively movably mounted within each of the top support members and is movable between extended and retracted positions. The solenoid is operatively connected to each of the locking bolts for moving the dead bolt from its extended position to its retracted position. An upstanding support is provided on each of the bottom support members which extends upwardly into the associated top support member and which is adapted to receive the locking bolt of the associated top support member to lock the assembly in its open position. When the solenoids are activated, the locking bolts are retracted from engagement with the supports so that when the lifting device raises the assembly, the top support members pivot with respect to the bottom support members to urge the front plates and back plates of the assembly into frictional engagement with the ends of the concrete blocks. A manual spring-loaded override is provided for manually moving each of the dead bolts to their retracted positions and to maintain the dead bolts in the retracted position by a locking mechanism. When the locking mechanisms are disengaged, the dead bolts return to their extended positions.

It is therefore a principal object of the invention to provide an improved multi-unit concrete block tong assembly.

A further object of the invention is to provide a multi-unit concrete block tong assembly which includes a solenoid operated dead bolt designed to lock the assembly in its open position, thereby eliminating the need for the presence of a worker.

A further object of the invention is to provide a concrete block tong assembly which is designed to lift and carry a plurality of concrete blocks.

A further object of the invention is to provide a concrete block tong assembly including means for rotating the same to properly position the assembly with respect to the concrete blocks to be lifted and carried and to permit the concrete blocks to be properly positioned within or at the job site.

A further object of the invention is to provide a multi-unit concrete block tong assembly which includes a solenoid operated dead bolt designed to lock the assembly in its open position and further including a spring-loaded manual override.

A further object of the invention is to provide a multi-unit concrete block tong assembly which includes a solenoid operated dead bolt designed to lock the assembly in its open position and further including a spring-loaded manual override and which further includes means for maintaining each of the dead bolts in their retracted positions when the manual overrides are employed.

These and other objects will be apparent to those skilled in the art.

DESCRIPTION OF THE PREFERRED EMBODIMENT

Figure 1:
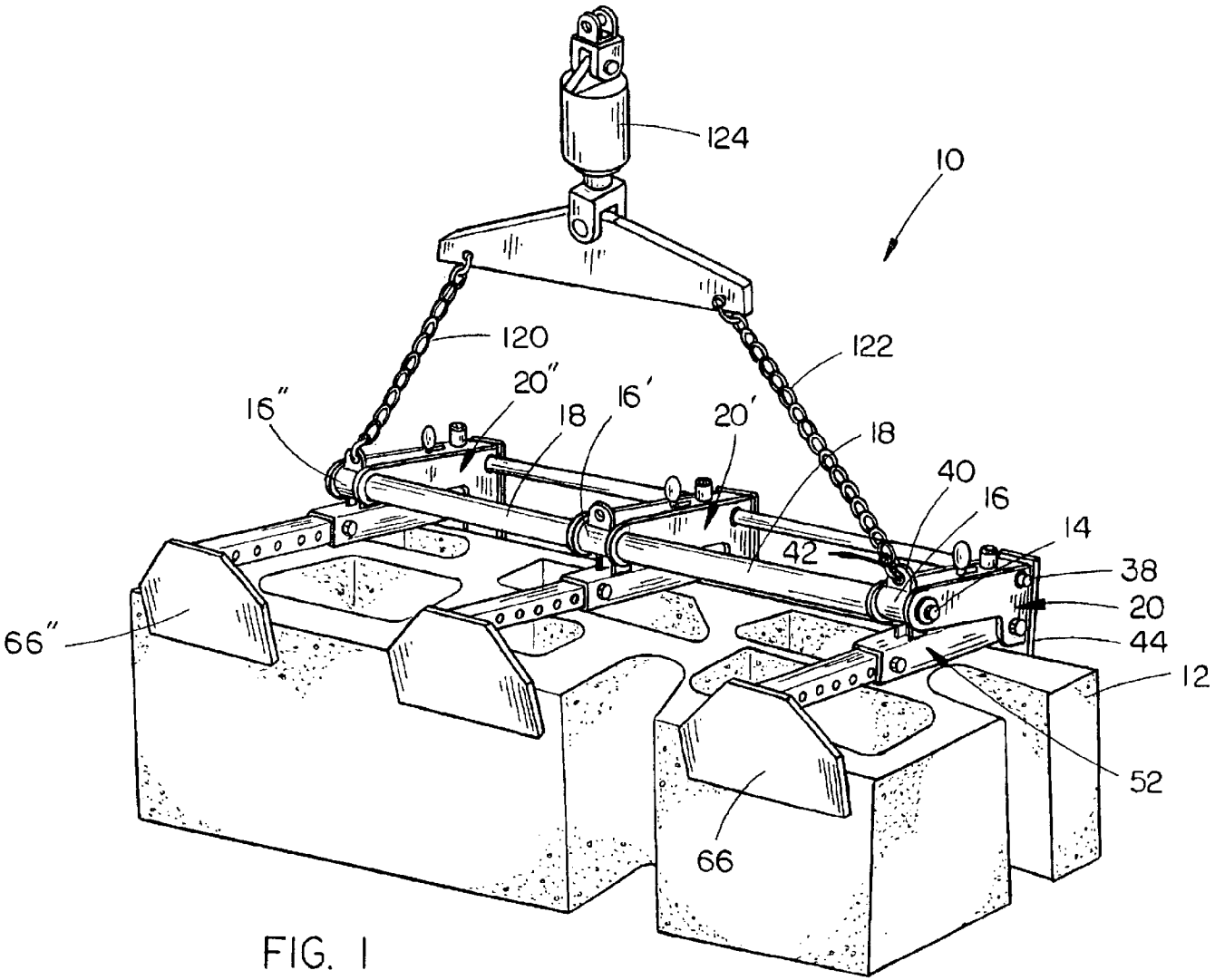
FIG. 1 is a perspective view illustrating the block tong assembly of this invention lifting a plurality of blocks.
Figure 2:
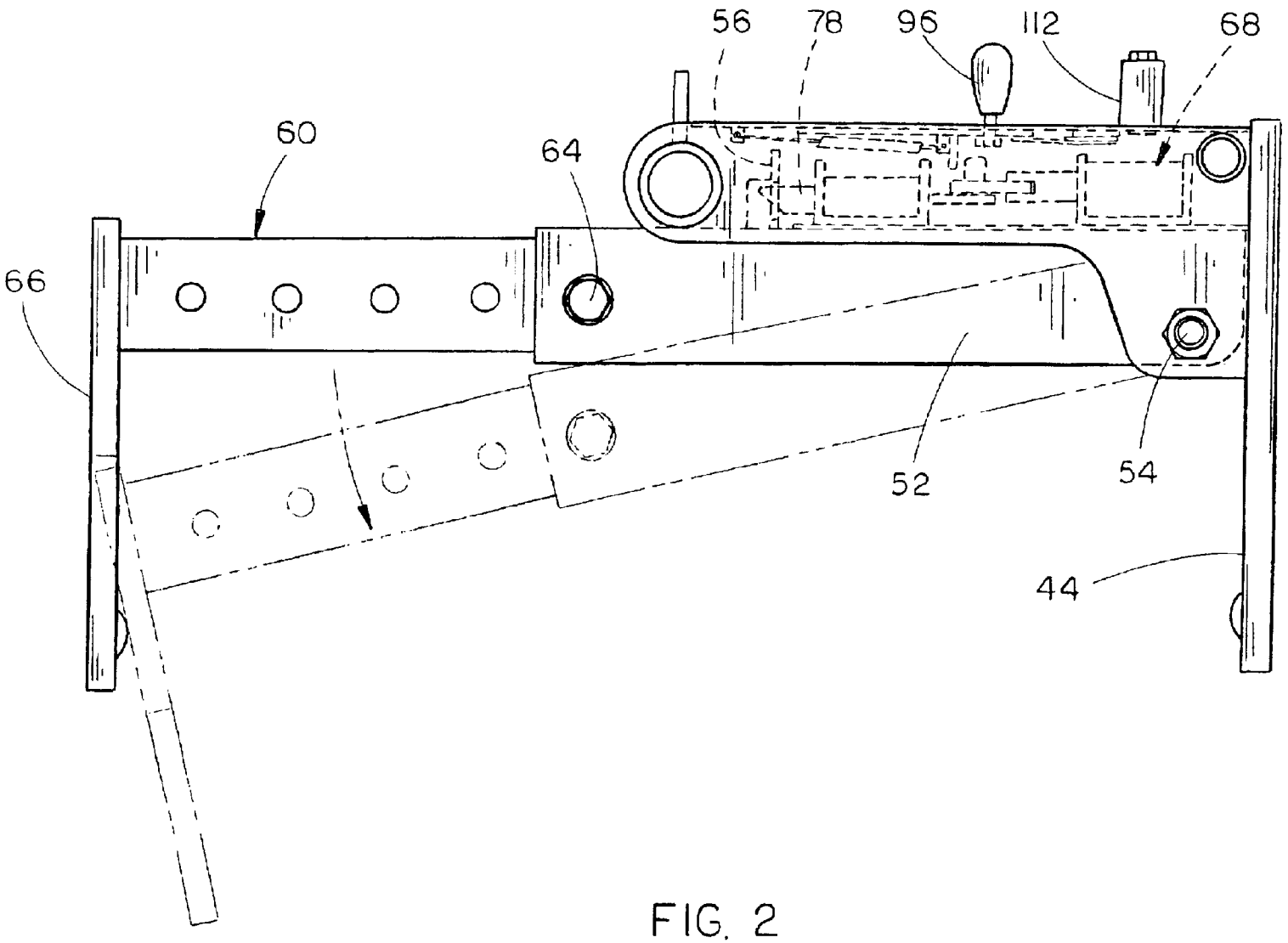
FIG. 2 is a side elevational view of the assembly with the broken lines illustrating the closed position of the assembly.

The block tong assembly of this invention is referred to generally by the reference numeral 10. Assembly 10 is designed to grasp and lift a plurality of blocks 12 such as those commonly used for retaining walls, steps, etc. Assembly 10 includes a first shaft 14 having sleeves or collars 16, 16' and 16" rotatably mounted thereon which have sleeves or collars 18 positioned therebetween. Assembly 10 includes a plurality of horizontally spaced-apart top support members 20, the number of which will depend upon the size of the assembly. The collars 16, 16' and 16" form a part of top support members 20, 20' and 20", each of which is identical. For that reason, only support member 20 will be described in detail with identical structure on support members 20' and 20" being identified with "'" and """" respectively.

Figure 3:
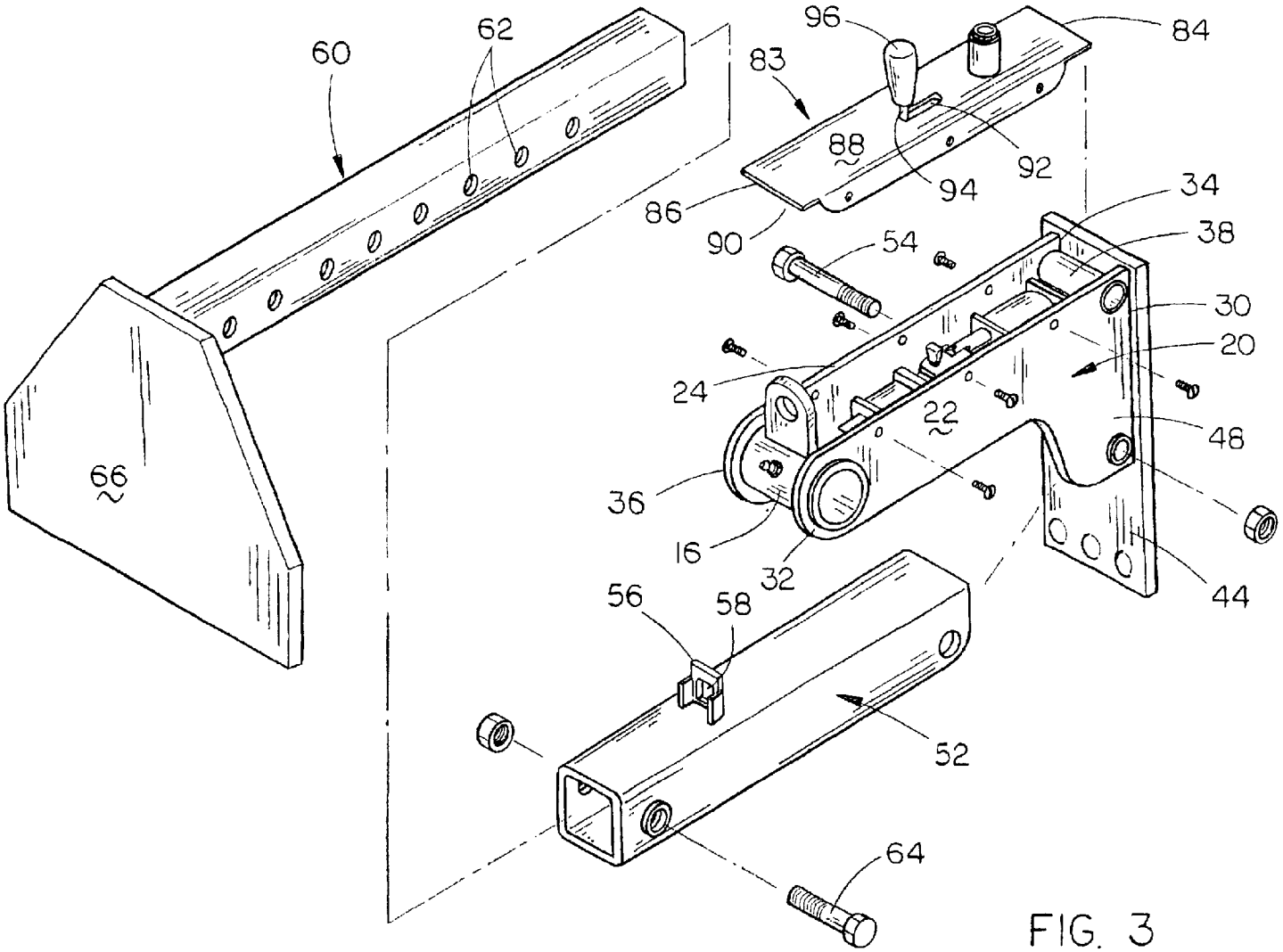
FIG. 3 is an exploded perspective view of one of the top support members, one of the bottom support members and the associated structure.
Figure 4:
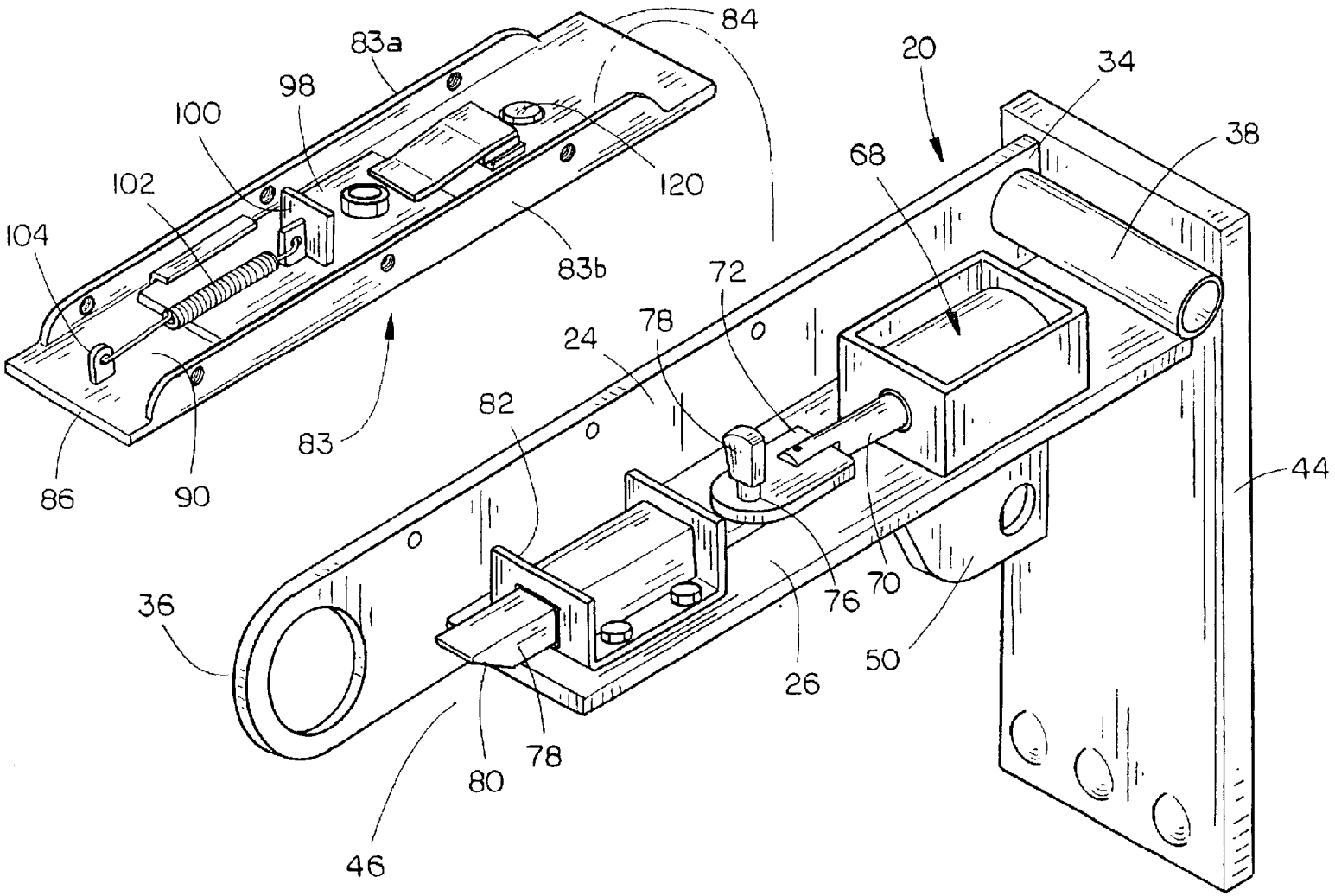
FIG. 4 is a partial exploded perspective view, with portions thereof cut away, to illustrate the solenoid actuator and the manual override.

Support member 20 includes side plates 22 and 24 and bottom plate 26 extending between the lower ends thereof to define a compartment 28. For purposes of description, side plate 22 will be described as including ends 30 and 32. Likewise, side plate 24 will be described as including ends 34 and 36. Collar 38 is secured to side plates 22 and 24 by welding or the like adjacent ends 30 and 34, respectively, and extends therethrough for rotatably receiving a shaft 38 therein. Bracket 40, having an opening 42 formed therein, is welded to collar 16, as seen in FIG. 1. Front plate 44 is welded to ends 30 and 34 of plates 22 and 24, respectively, and extends downwardly therefrom (FIG. 3). As seen in FIG. 4, bottom plate 26 terminates inwardly of ends 32 and 36 of plates 22 and 24, respectively, to define an opening 46 for a purpose to be described hereinafter. Side plates 22 and 24 are provided with downwardly extending ears 48 and 50, respectively, to which is pivotally mounted one end of bottom support member or tube 52 by means of bolt 54. Bracket 56, having an opening 58 formed therein, is welded to the upper surface of bottom tube 52 and is adapted to be received by the opening 46 in bottom plate 26 when the tube 52 and top support member 20 are parallel to one another.

One end of tube 60, having spaced-apart openings 62 formed therein, is selectively slidably received in tube 52 and maintained in selected positions by bolt 64. Back plate 66 is welded to the outer end of tube 60 and extends downwardly therefrom.

The numeral 68 refers to an electrically operated 12-volt solenoid secured to bottom plate 26 adjacent one end of compartment 28. Solenoid 68 has an actuator rod 70 extending therefrom which is movable between extended and retracted positions. Plate 72 is secured to the outer end of rod 70 and has an opening 74 formed therein which receives knob 76 therein. Knob 76 is connected to a slidable locking bolt 78 having a beveled end 80.

Locking bolt 78 is slidably mounted in a support 82 which is secured to bottom plate 26. The extension of actuator rod 70 by solenoid 68 causes bolt 78 to be moved to its locking position while the retraction of rod 70 by solenoid 68 causes bolt 78 to be moved to its unlocked position. Solenoid 68 is spring-loaded in conventional fashion so that rod 70 is normally extended until solenoid 68 is actuated. Thus, locking bolt 78 is normally in its locked position until solenoid 68 is actuated or until the locking bolt 78 is manually moved to its unlocked position as will be described hereinafter. When top support member 20 and bottom tube 52 are parallel to one another, the upper end of bracket 56 extends upwardly through opening 46 in bottom plate 26 so that opening 58 in bracket 56 is aligned with locking bolt 78. When the apparatus of this invention is in its open position (non-block supporting), the beveled end 80 of bolt 78 is received by opening 58 in bracket 56 to maintain the support member 20 and tube 52 in their parallel position so that the assembly is in its "open" position. When solenoid 68 is actuated, the rod 70 is retracted into solenoid 68 which causes bolt 78 to retract from its locked position within opening 58 of bracket 56 so that the support member 20 and tube 52 may pivot with respect to one another.

Figure 5:
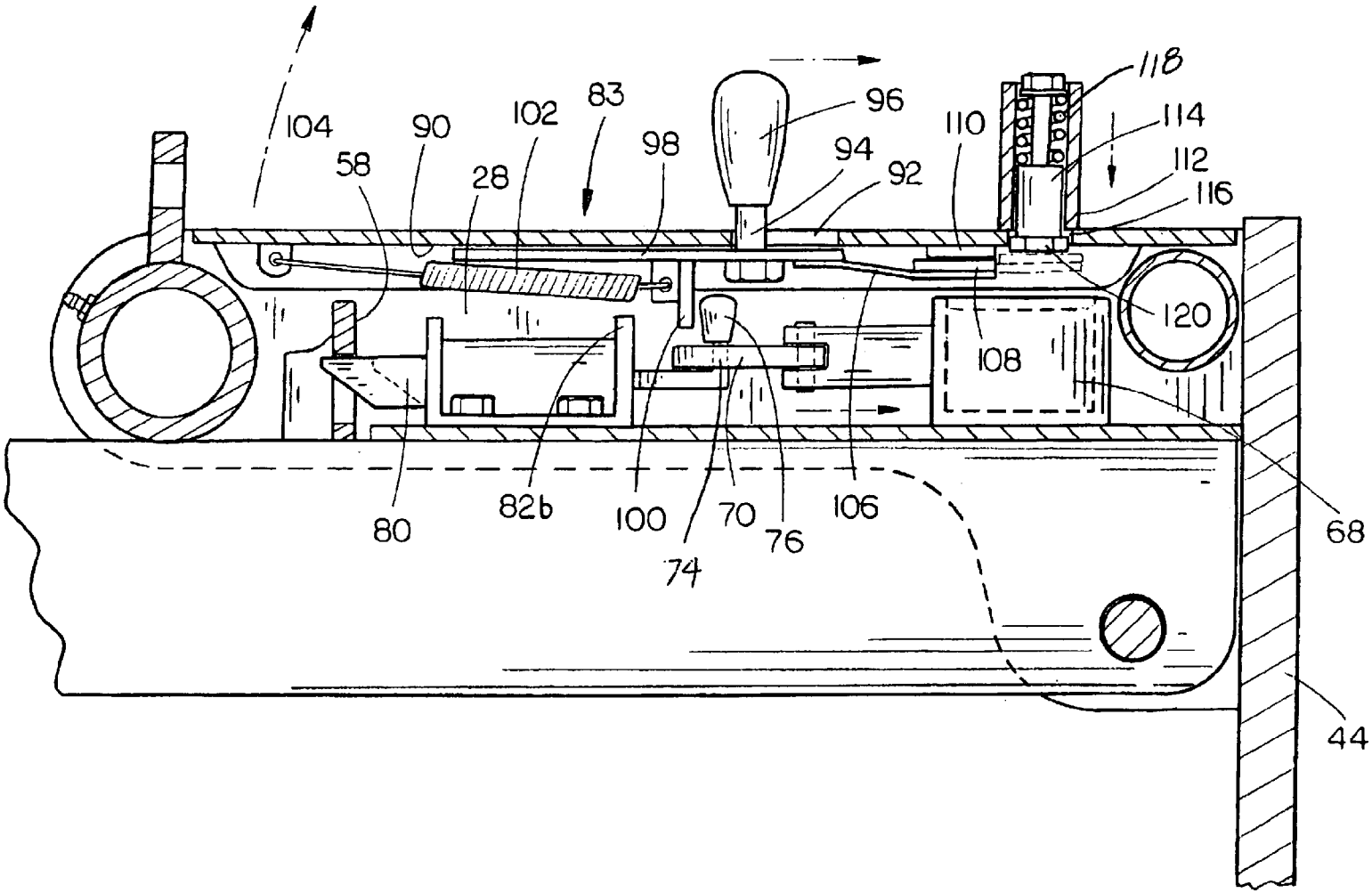
FIG. 5 is a partial vertical sectional view of the structure of FIG. 4.
Figure 6:
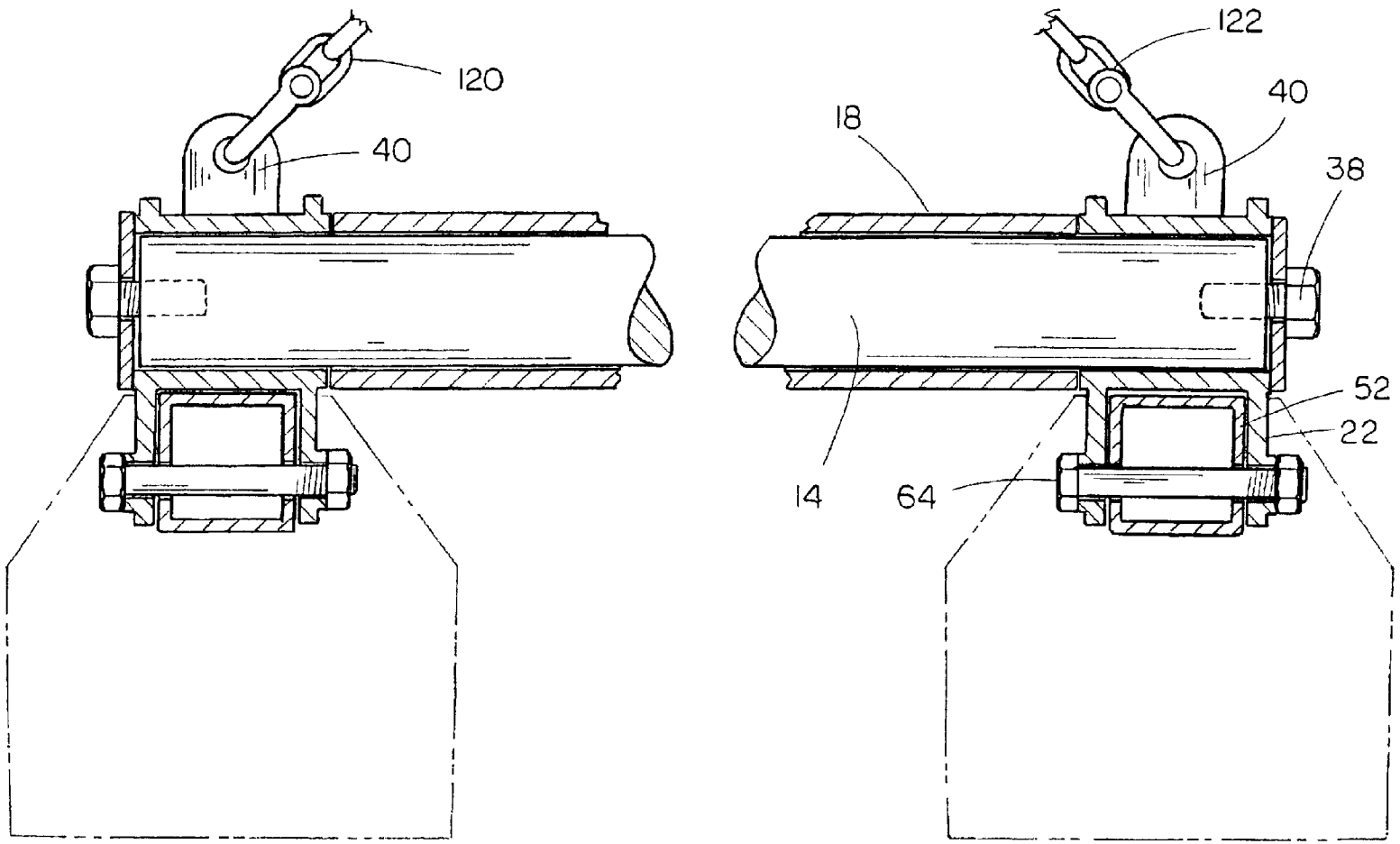
FIG. 6 is a partial vertical sectional view of the assembly.

The numeral 83 refers to a cover, lid or plate which is selectively mounted on the upper ends of plates 22 and 24 to close the upper end of compartment 28. For purposes of description, cover 83 will be described as having ends 84 and 86, upper surface 88 and bottom surface 90. Cover 82 also includes side portions 83*a* and 83*b*. Cover 83 includes an elongated slot 92 formed therein which has a bolt 94 received therein with the upper end of the bolt 94 having a knob 96 mounted thereon. The lower end of bolt 94 is secured to a guide plate 98 having a square or rectangular tab or ear 100 extending downwardly therefrom. Spring 102 extends between tab 100 and ear 104 which extends down from the bottom surface 90 of cover 83 to urge guide plate 98 to the left, as viewed in FIG. 5. Leaf spring 100 is secured to one end of plate 98 (FIG. 5). A square or rectangular plate member 108 is secured to the upper surface of leaf spring 106. As seen in FIG. 5, a square or rectangular plate member 110 is secured to the bottom surface of cover 83.

A collar 112 is secured to the upper surface 88 of cover 83 and has a spring-loaded actuator 114 mounted therein, the lower end of which is positioned in opening 116 formed in cover 83. Spring 118 normally urges actuator 114 to its upper position. The lower end 120 of actuator 114 is adapted to engage plate member 108 when the bolt 94 is in its locked position and when actuator 114 is moved downwardly from opening 116.

When cover 83 is mounted on the upper ends of plates 22 and 24 to close the upper end of compartment 28, and actuator rod 70 is in its extended position, tab 100 is positioned between knob 76 and support member 82*a* of support member 82 and does not interfere with the normal extension and retraction of actuator rod 70 (and knob 76) so that solenoid 68 may move locking bolt 80 out of locking engagement with bracket 56. When locking bolt 80 is not locked, upward movement of chains 120 and 122 will cause top support member 20 to pivot with respect to tube 52 so that plates 44 and 66 are moved into frictional gripping engagement with the blocks 12 to enable the same to be lifted and moved to the desired location.

Assuming that the vehicle does not have electrical power to operate solenoid 68 or that power is lost for operating solenoid 68, the locking bolt 80 may be moved out of locking engagement with bracket 56 by moving knob 96 towards the right, as viewed in FIG. 5, which causes tab 100 to engage knob 76 and move the same to the right until plate 108 has moved past the end of plate 110 at which time the resiliency of the leaf spring 106 causes plate 108 to move upwardly and be locked in that position by the engagement of the end of plate 108 with the end of plate 110.

With the locking bolt 80 out of engagement with the bracket 58, the upper support member 20 and the bottom tube 52 are free to pivot from their "open" position to their closed block-gripping position. When the blocks have been lifted and moved to the desired location, the blocks are lowered onto the ground or some other supporting surface. Tension in the chains 120 and 122 is relaxed which causes the relative pivotal movement between support member 20 and the bottom tube 52 so that the same are in their "open" position. The assembly 10 is then raised with respect to the blocks. The assembly 10 is then maneuvered into position with another set of blocks to be lifted and the assembly 10 is lowered onto the same. When the assembly 10 has been properly positioned, each of the actuators 114 is depressed which causes plate 108 to be moved downwardly from its locking position adjacent plate 110 with the spring 102 causing the guide plate 98 to be moved to the position of FIG. 5. The spring-loaded solenoid 68, although not having power supplied thereto, causes the actuator rod 70 to move to the left to the position of FIG. 5 so that locking bolt 80 engages bracket 56 so that the assembly is again in its locked "open" position.

Preferably, a rotary actuator 124 is operatively connected to the upper ends of the chains 120 and 122 so that the assembly may be rotated as desired. The rotator assembly 124 is supported from the end of a boom on a skid steer loader or the like.

Thus it can be seen that the invention accomplishes at least all of its stated objectives.

I claim:

1. A concrete block tong assembly, comprising:

a first horizontally disposed shaft having first and second ends;

a plurality of horizontally spaced-apart top support members having first and second ends;

said first ends of said top support members being operatively rotatably connected to said first shaft;

a front plate secured to said first end of each of said top support members and extending downwardly therefrom;

a plurality of horizontally spaced-apart bottom support members having first and second ends;

said first ends of said top support members being pivotally secured to said first ends of said bottom support members;

said bottom support members having a greater length than said top support members;

said top support members being positioned above said bottom support members;

said top support members being pivotally movable from a first position to a second position with respect to said bottom support members;

said second ends of said top support members being positioned closely adjacent said bottom support members when in their said first position;

said top and bottom support members being substantially parallel to one another when said top support members are in their said first position;

said top support members being angularly disposed with respect to said bottom support members when in their said second positions;

a second shaft operatively secured to said top support members adjacent said second ends thereof and extending therebetween;

a back plate secured to each of said bottom support members adjacent said second end thereof which extends downwardly therefrom;

an upstanding support secured to each of said bottom support members adjacent said second end of the associated top support member;

a locking bolt slidably mounted in each of said top support members and being movable between an extended position and a retracted position;

said locking bolts being in operative engagement with said upstanding supports, when in their said extended position, to maintain said top support members in their said first position with respect to said bottom support members;

an electric actuator mounted on each of said top support members;

each of said electric actuators including an actuator rod which is operatively connected to an associated locking bolt;

each of said actuator rods normally being in an extended position but being retracted into the associated electric actuator when said electric actuator is actuated;

a manual override mechanism mounted on each of said top support members;

said manual override mechanism being adapted to move the associated locking bolt to its retracted position and to lock the same in its said retracted position.

* * * * *